United States Patent [19]

Binder et al.

[11] 4,383,290

[45] May 10, 1983

[54] SIGNAL LAMP

[75] Inventors: Helmut Binder, Bietigheim-Bissingen; Gerhard Haar, Leinfelden; Eckhardt Schmid, Guglingen; Hans-Joachim Wirth, Heilbronn, all of Fed. Rep. of Germany

[73] Assignee: ITT Industries Inc., New York, N.Y.

[21] Appl. No.: 164,054

[22] Filed: Jun. 30, 1980

Related U.S. Application Data

[63] Continuation of Ser. No. 944,803, Sep. 22, 1978, abandoned.

[30] Foreign Application Priority Data

Sep. 29, 1977 [DE] Fed. Rep. of Germany ..... 2743777
Aug. 16, 1978 [DE] Fed. Rep. of Germany ..... 2835808

[51] Int. Cl.[3] ..... F21V 9/00

[52] U.S. Cl. ..... 362/290; 362/80; 362/291; 362/292; 362/293; 362/309; 362/328; 362/329; 362/339

[58] Field of Search ..... 362/80, 307, 343, 342, 362/354, 290, 291, 292, 293, 328, 329, 339

[56] References Cited

U.S. PATENT DOCUMENTS 3,085,151 4/1963 Kritz ..... 362/290

*Primary Examiner*—Stephen J. Lechert, Jr.
*Attorney, Agent, or Firm*—James B. Raden; Donald J. Lenkszus

[57] ABSTRACT

A signal lamp is disclosed for use in automotive vehicles. The lamp includes a housing, a reflector for producing parallel rays, a lens closing the housing in the direction of light exit and diaphragms mounted behind the lens. The outside of the lens is provided with non-reflecting or weakly reflecting transverse stripes to avoid undesired reflections. In one advantageous embodiment, the diaphragms are positioned only in an upper portion of the lamp.

27 Claims, 7 Drawing Figures

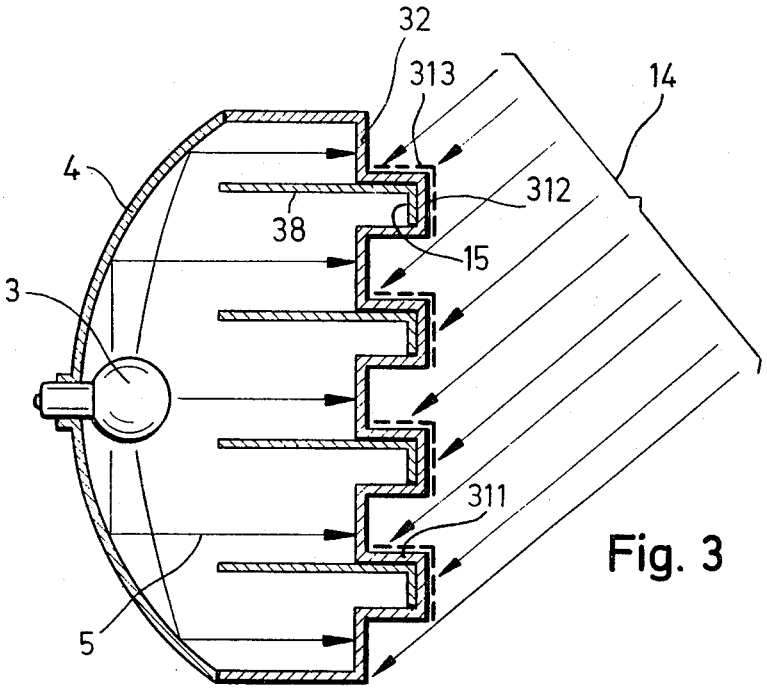
Fig. 3
Fig. 6
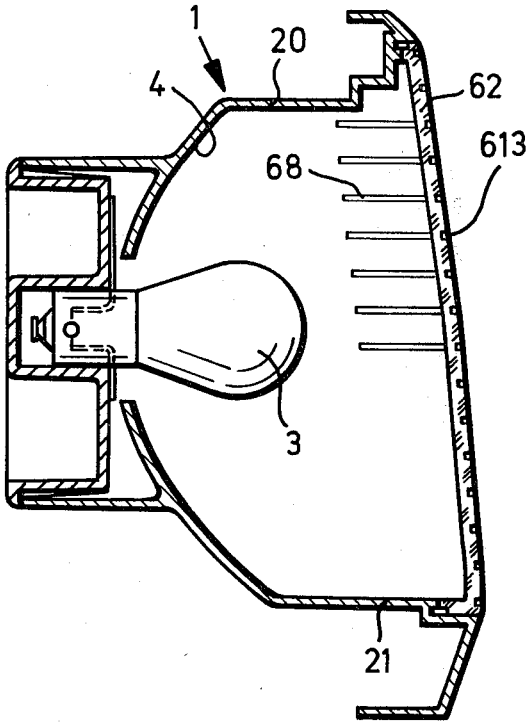

SIGNAL LAMP

This is a continuation of application Ser. No. 944,803, filed Sept. 22, 1978, now abandoned.

BACKGROUND OF THE INVENTION

1. Field of the Invention

The invention relates to signal lamp assemblies in general and to vehicular signal lamp assemblies in particular.

2. Description of the Prior Art

A signal lamp mounted on the rear of a motor vehicle or also a traffic light under unfavorable conditions can be irradiated by an outside light source, for instance by the sun, in such a manner that when the lamp is off, a misleading colored reflection is caused which makes the lamp appear to be on. For traffic safety reasons, this outside or phantom light should be prevented as far as possible. Three kinds of phantom light may occur: the real colored phantom light having a signalling effect created by reflection on the optical system of the lamp glass; the mirror phantom light created by reflection on the reflector itself which also has a colored signalling effect; and the reflected-light phantom which is created by reflection on the glass surface. The reflected light phantom is a white reflex not having a direct signalling effect. In connection with the two first-mentioned kinds of phantom light, the colored signalling effect is supported, however.

In order to reduce this phantom light behind the lens of a light according to the French Pat. No. 610 148, horizontally extending diaphragms were incorporated. By this measure, however, only the mirror phantom light can efficiently be overcome. Especially in extreme cases, for instance upon very intensive solar irradiation, this lamp still causes wrong signalling effects because of the still existing real phantom light.

It is also known from German Pat. No. 1,223,279 that tilting the lens will reduce the reflected light phantom and thus, the white reflex. However, tilting the lens does not reduce the two first mentioned kinds of phantom light.

SUMMARY OF THE INVENTION

It is an object of the present invention to obtain a signal lamp in which the influence of the entire phantom light is reduced to such an extent that even in extreme situations only an intended signalling is possible without a considerable loss of light.

This is achieved according to the invention in that the outside of the lens is provided with nonreflecting or only slightly reflecting transverse stripes. By this measure, it is possible to reduce also the real phantom light pretending a signalling effect and being created by reflection on the optical system of the lens and partly also the reflected-light phantom, the white reflex, to an extent that also under unfavorable light conditions, a nonexisting function of the lamps is not pretended.

In one advantageous embodiment of a signal lamp according to the invention, the loss of light during desired signalling will be extremely small.

In that embodiment, a signal lamp further includes diaphragms mounted behind the lens only in an upper portion of the lamp. The light produced by a bulb can emerge from the lamp in the lower part without being weakened by the diaphragms. The light entering the lower half of the lens from outside results only in a minimum increase of the mirror phantom light because these rays, in accordance with the principles of geometric optics, are refracted and reflected several times within the lamp in a way that they fall mainly on nonreflecting surfaces of the lamp housing or of the existing diaphragms.

Additionally, the white reflex can be reduced if, in accordance with the principles of the invention in addition to the above-mentioned features, the lens is tilted.

BRIEF DESCRIPTION OF THE DRAWINGS

The invention may be better understood from a reading of the following detailed description in conjunction with the drawings in which like reference numerals designate like parts and in which:

FIGS. 3 through 5 are longitudinal sections of further signal lamp embodiments; and FIG. 6 illustrates yet a further signal lamp having diaphragms only in an upper portion.

DETAILED DESCRIPTION OF THE DRAWINGS

Figure 1:
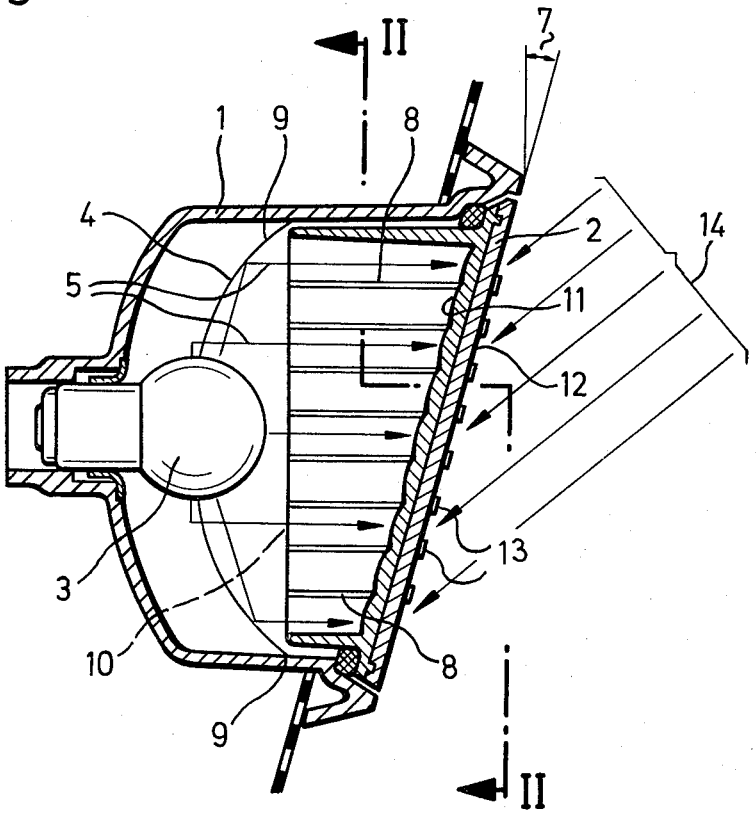
FIG. 1 is a longitudinal section through a signal lamp.
Figure 2:
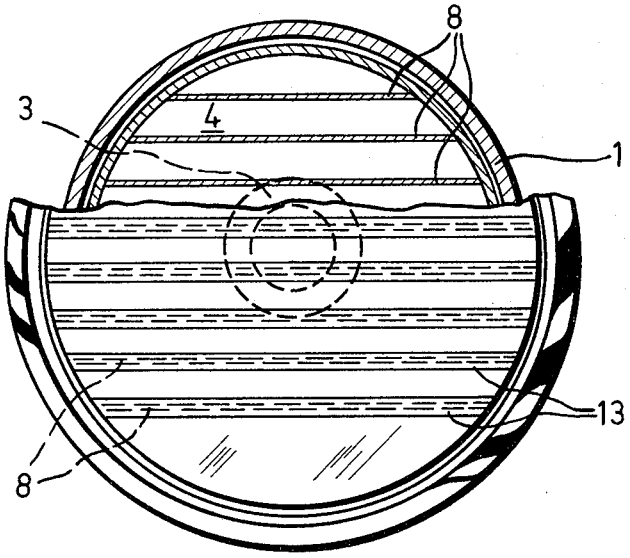
FIG. 2 is a section taken in the line II—II of FIG. 1.

The signal lamp of FIGS. 1 and 2 includes a housing 1 supporting a lamp bulb 3 and a reflector 4 for producing a bundle of substantially parallel light rays 5. The housing is closed by a lens 2. Transversely, extending diaphragms 8 are located between the reflector 4 and the lens 2. The diaphragms 8 extend from the lens 2 to an imaginary connecting line 10 between the reflector ends 9. The lens 2, which in FIG. 1 is installed at an angle 7 of approximately 14°, include two pieces including an optical portion 11 and a light filter 12. Nonreflecting or slightly reflecting transverse stripes 13 are located on the light filter 12. The rays of outside light are designated by 14.

In the signal lamp according to FIG. 1, the losses of light are additionally reduced in that the transverse stripes 13 and the diaphragm 8 each are arranged at the level of the transitions between two objective glasses or corrugated parts of the optical part 11. Through these areas because of the effect of the optical part 11, little or no light is radiated so that the transverse stripes do not weaken the light. The different depths of the individual diaphragms 8 contribute to a greater reduction of the phantom light whereas the signalling light is only slightly reduced. Thus, it is most favorable when the depths of the diaphragms decrease from top to bottom. The lateral surfaces 20 and 21 of the lamp housing 1, in addition, can be provided with a nonreflecting coating so that intruding light can be absorbed still quicker and to a larger extent.

Figure 2A:
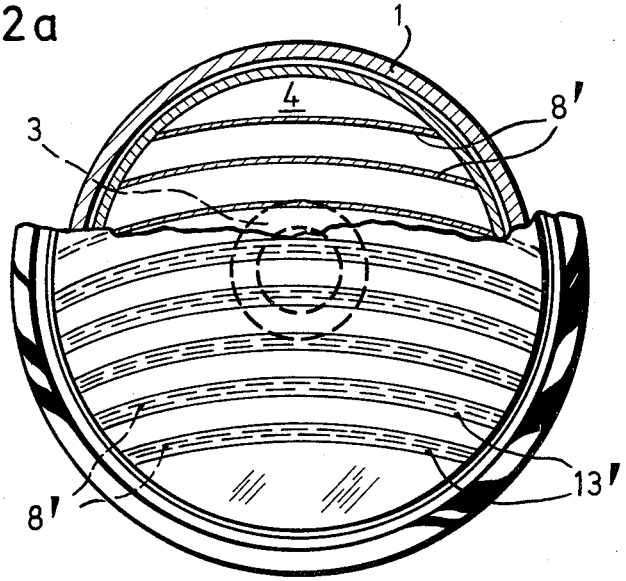
FIG. 2*a* is a section taken in the line II—II of FIG. 1 with curved stripes and diaphragms.

FIG. 2*a* shows an alternative solution in the same configuration as in FIGS. 1 and 2 in which, in comparison to FIG. 1, the diaphragms are curved and designated by 8' or 13'.

In the embodiment according to FIG. 3, the lens 32 includes rectangular ridges. The construction of the signal lamp in itself corresponds to that of FIG. 1. The diaphragms 38 are bent rectangularly and in the end are 13 adapted to the cover portion 311. In the same manner, the transverse stripes 313 are adapted to the surface of the light filter 312.

Figure 4:
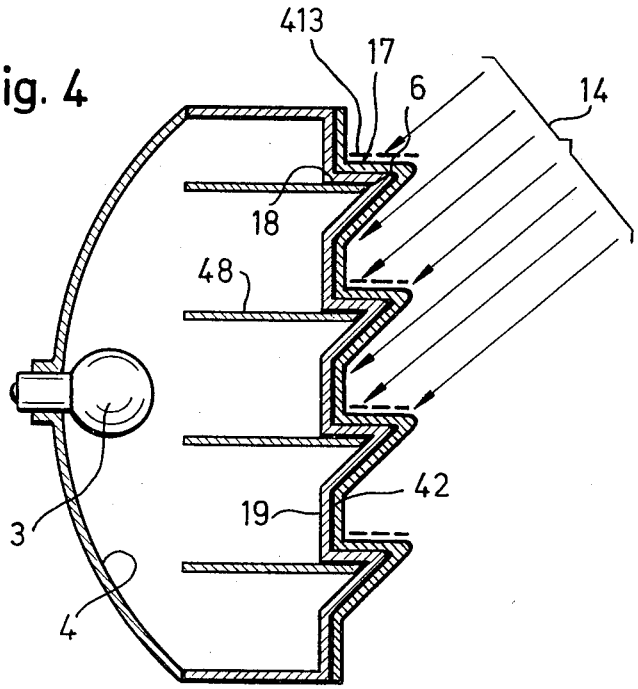
Figure 5:
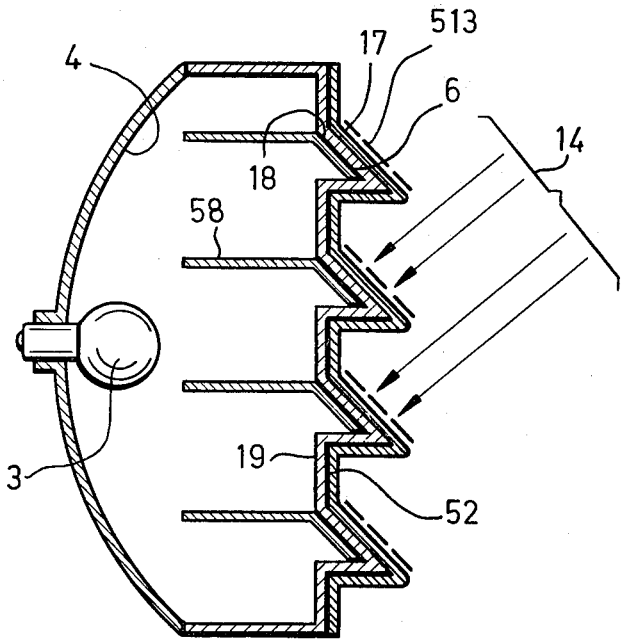

FIGS. 4 and 5 show two further alternative embodiments. The signal lamps are, in principle, designed like the lamp according to FIG. 1. However, the lenses 42 and 52, respectively, of these embodiments, are saw-toothed. Thereby, the diaphragms 48 and 58 each are conducting as far as into the tips 6. The transverse stripes 413 and 513 cover the light filter portion 17, being located opposite to the optical portion 18 acted upon by the diaphragm. By variation of the vertical portions 19 of the lens 42 and 52, the reduction of the outside light reflection can additionally be adapted to the respective requirements.

The embodiments of the FIGS. 3 to 5 may be provided with a curved profiling of the lens as well as with curved diaphragm transverse strips as in the embodiment according to FIG. *2a*. Also, the optical portion may be separate from the light filter whereby a smooth plane outside surface of the lens would be obtained.

The signal lamp of FIG. 6 has diaphragms 68 positioned only in its upper half. These diaphragms are exactly located inside the lens 62 in alignment with the transverse stripes 613. The depth of the diaphragms 68, together with the transversal stripes 613, is so selected that no beams of light can enter the upper half of the lamp housing, said beams together with the horizontal line enclosing an angle larger than 18°. The diaphragms 68 are shown as being of uniform depth, however, the diaphragms may also be of different depths decreasing from top to bottom.

Beside the saving of material and thereby cutting of costs by locating the diaphragms only in the upper half, the signal lamp according to FIG. 6 has the further advantage that the increased efficiency of the luminous source permits painting or varnishing the reflector silver-colored. A vapor-deposition with aluminum is not necessary so that the cost situation will be even more favorable.

In the signal lamp according to FIG. 6, no optical part is shown. It can, however, be easily understood that here too with the available objective glasses or corrugated parts the transverse stripes 613 and the diaphragms can be advantageously arranged at the level of the transitions between said optical elements. The restriction of the diaphragms to the upper half of the signal lamp and the location of the transverse stripes at the level of the transitions between the optical elements independently of each other to a large extent contribute favorably to influence the radiated light. A combination of the two features, however, influences the light value of the signalling lamp in a particularly favorable manner.

What is claimed is:

1. A signal lamp comprising:

a housing;

a reflector for producing a substantially parallel bundle of light rays;

a lens closing the housing in the direction of exit of said light rays;

a plurality of substantially parallel vertically spaced apart diaphragms mounted behind said lens;

a plurality of substantially parallel vertically spaced-apart horizontal transverse stripes on the outside of said lens, each of said stripes being relatively non-reflective and each of said stripes being arcuate along its length when viewed from the front of said lens such that each stripe approximates a circular segment having a radius greater than the radius of said lens;

each of said diaphragms comprising a cylindrical segment having a radius greater than the radius of said lens such that each diaphragm is arcuate in shape when viewed from the front of said lens and each of said diaphragms being in registered alignment with a corresponding one of said plurality of stripes.

2. A signal lamp according to claim 1, wherein each of said plurality of transverse stripes are formed as frosted areas of said lens.

3. A signal lamp especially according to claim 1, wherein said plurality of diaphragms are located in an upper portion of said signal lamp.

4. A signal lamp according to claim 1, wherein each of said plurality of diaphragms extends to a different depth behind said lens.

5. A signal lamp according to claims 1, or 3, wherein said lens includes an optical part comprising a plurality of convex optical surfaces and each of said diaphragms is positioned at the transition between a corresponding pair of said plurality of optical surfaces.

6. A signal lamp according to claim 2, wherein said reflector is varnished silver-colored.

7. A signal lamp according to claims 1, 2, or 3, wherein said lens is inclined.

8. A signal lamp according to claim 1, wherein the angle of inclination of said lens is approximately 14° from vertical.

9. A signal lamp according to claims 1,2, or 3, wherein said lens comprises a plurality of parallel corrugations of generally sawtooth-shaped cross-section said corrugations being spaced apart vertically, each of said corrugations being arcuate along its length when viewed from the front of the lens such that each corrugation approximates a circular segment having a radius greater than the radius of said lens.

10. A signal lamp according to claim 9, wherein the inclined portions of each of said plurality of saw-tooth corrugations is approximately 14°.

11. A signal lamp according to claim 10, wherein each of said plurality of diaphragms has an end portion extending along one interior surface of a corresponding one of said plurality corrugations.

12. A signal lamp according to claim 11, wherein said end portion is adapted to engage an interior surface of the inclined portion of said corresponding one of said plurality of corrugations.

13. A signal lamp according to claims 1,2, or 3, wherin said lens comprises a plurality of parallel rectangular corrugations, said corrugations being spaced apart vertically, each of said corrugations being arcuate along its length when viewed from the front of the lens such that each corrugation approximates a circular segment having a radius greater than the radius of said lens.

14. A signal lamp according to claim 13, wherein each of said diaphragms has an end portion extending along one interior surface of a corresponding one of said rectangular corrugations.

15. A signal lamp according to claim 14, wherein each of said diaphragms has a second portion extending along a second interior surface of said corresponding one of said rectangular corrugations.

16. A signal lamp comprising:

a housing;

a lamp in said housing;

a reflector positioned relative to said lamp for producing a substantially parallel bundle of light rays;

a lens closing the housing in the direction of exit of said light rays, said lens comprising a plurality of convex optical surfaces, each of said plurality of convex optical surfaces acting as an objective lens; and a plurality of substantially parallel, vertically spaced apart diaphragms mounted between said lens and said reflector, each of said plurality of diaphragms being positioned at the transition between a corresponding pair of said plurality of convex optical surfaces.

17. A signal lamp in accordance with claim 16, wherein said lens comprises a first inner portion carrying said convex optical surface; and a second, outer colored portion.

18. A signal lamp in accordance with claim 17, wherein said second portion has a plurality of substantially parallel, vertically spaced apart transverse stripes, each of said stripes being relatively non-reflective and each of said stripes being in registered alignment with a corresponding one of said plurality of stripes.

19. A signal lamp in accordance with claim 18, wherein said lens is inclined from vertical by a predetermined angle.

20. A signal lamp in accordance with claim 19, where said predetermined angle is approximately 14 degrees.

21. A signal lamp in accordance with claims 19 or 20, wherein each of said plurality of diaphragms extends behind said lens to a predetermined distance from said lamp.

22. A signal lamp in accordance with claims 16, 17, 18, 19 or 20, wherein each of said plurality of diaphragms comprises a cylndrical segment having a radius greater than the radius of said lens such that each diaphragm is accurate in shape when viewed from the front of said lens.

23. A signal lamp in accordance with claim 22, wherein said reflector has a silver colored reflecting surface.

24. A signal lamp comprising:

a lamp;

a reflector for producing a substantially parallel bundle of light rays fromsaid lamp;

a lens spaced apart from said reflector said lens having a plurality of sawtoothed shaped corrugations, each of said corrugations having a substantially horizontal position and an inclined portion, the inclined portion of each of said corrugations having a predetermined angle of inclination from vertical;

a plurality of diaphragms each extending from a corresponding one of said corrugations each of said diaphragms having a portion extending to the intersection of the interior surfaces of the the inclined and horizontal portions of said corresponding one corrugation, each of said corrugations having a substantially non-reflecting stripe on one of said horizontal or inclined portions.

25. A signal lamp in accordance with claim 24, wherein said predetermined angle is 14 degrees.

26. A signal lamp in accordance with claims 24 or 25, wherein said lens comprises a first interior part carrying said diaphragms and a second exterior part carrying said stripes.

27. A signal lamp in accordance with claim 26, wherein said exterior part is colored.

* * * * *